United States Patent [19]

Brach et al.

[11] Patent Number: 4,562,931

[45] Date of Patent: Jan. 7, 1986

[54] PILFER-PROOF CLOSURE WITH TEAR-AWAY HOLDING CLAWS

[75] Inventors: Ulrich Brach; Alois Persch, both of Zell, Fed. Rep. of Germany

[73] Assignee: Zeller Plastik, Koehn, Gräbner & Co, Zell, Fed. Rep. of Germany

[21] Appl. No.: 658,750

[22] Filed: Oct. 9, 1984

[30] Foreign Application Priority Data

Oct. 11, 1983 [DE] Fed. Rep. of Germany ..... 3336908

[51] Int. Cl.[4] ..... B65D 55/02

[52] U.S. Cl. ..... 215/220; 215/253; 215/256

[58] Field of Search ..... 215/219, 220, 253, 256, 215/258

[56] References Cited

U.S. PATENT DOCUMENTS

| | | | |
|---|---|---|---|
| 3,944,102 | 3/1976 | Grau | 215/220 |
| 4,330,067 | 5/1982 | Deuggen | 215/220 |
| 4,474,301 | 10/1984 | Davis | 215/220 |

*Primary Examiner*—George T. Hall
*Attorney, Agent, or Firm*—Wells & Wells

[57] ABSTRACT

The invention concerns an original-seal closure means made of plastic and for threaded mouths at containers, in particular bottles. The closure means includes a screw cap to which a hood is fastened with axial play. Studs are present at both the hood and the screw cap, which can be engaged and disengaged within the said axial play and which act as drive means. To secure the original seal, the screw cap is provided with tear-off elements which engage by means of claws underneath the retainer lip. When the mouth is sealed, the claws are held in this position by the hood. When the closure is opened the first time, the tear-off elements are perforce torn off. In additional child-proof design, a set of studs is designed in such a manner that they shall always act as drive means during the screwing shut process while they shall act thusly during unscrewing only if in addition to the torque an axial force is exerted toward the mouth.

14 Claims, 9 Drawing Figures

Fig. 6
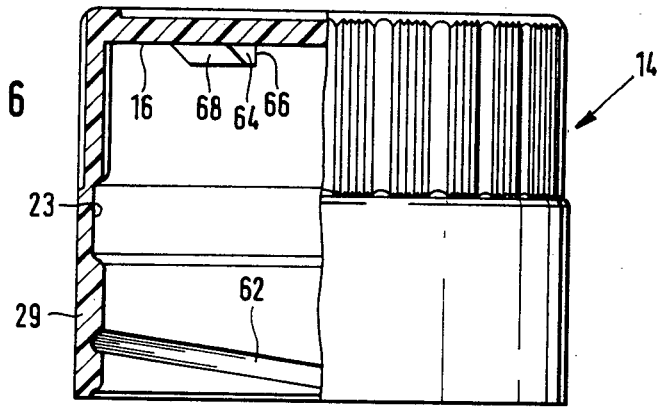
Fig. 7
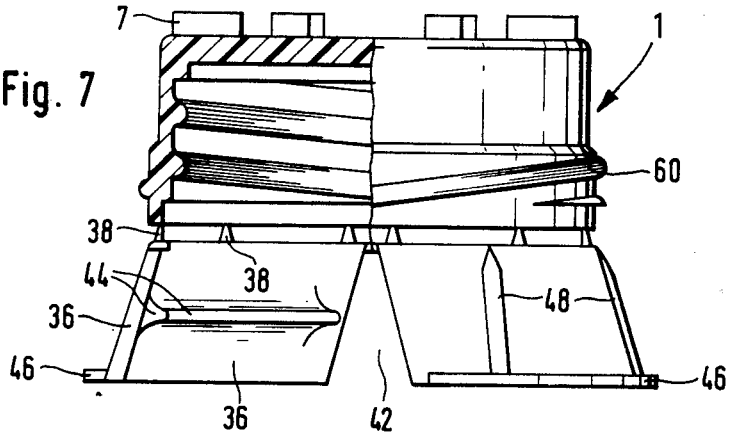
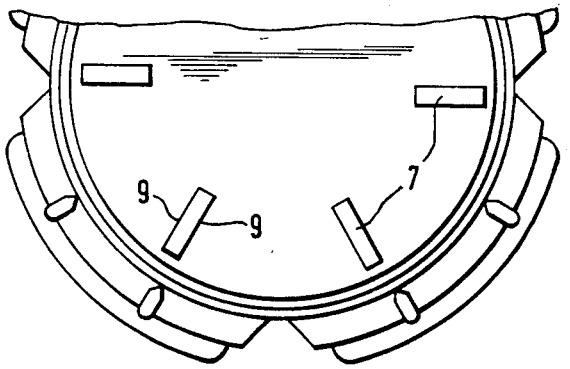
Fig. 8

PILFER-PROOF CLOSURE WITH TEAR-AWAY HOLDING CLAWS

BACKGROUND OF THE INVENTION

The invention concerns an original-seal closure means with the features cited in the preamble of claim 1. The state of the closure means shall indicate whether after the original sealing the closure means has been opened or not.

Original-seal closure means made of sheetmetal are known, wherein the sealing cap has a smooth, cylindrical side which is flanged by means of the thread of a mouth and underneath the retaining lip.

Known original-seal closure means made of plastic are similar in design. In this case the lower edge zone must be so thermally shaped that it will engage underneath the retaining lip.

None of these original-seal closure means can be assembled using conventional sealing machines in an operation where liquids are filled.

SUMMARY OF THE INVENTION

The object of the present invention is to so design a plastic original-seal closure means that it can be assembled to threaded mouths with retaining lips using conventional sealing machines. Furthermore, after the first opening entailing the destruction of its original-seal feature, the closure means shall allow arbitrarily repeated manual closing and opening.

This problem is solved as stated in claim 1, the text of which will be referred to below.

The hood is undetachably mounted to the screw cap. The hood is freely movable within a specific play so that the studs or studs and recesses required to transmit a torque from the hood to the screw-cap can engage and disengage.

Such a closure means can very easily be screwed manually or by sealing machines on bottles. When screwing tight, and also when unscrewing later, the studs or the studs and recesses so rest against each other that the screw cap is driven by the hood.

When the closure-means is opened for the first time, the tear-off elements are separated and thus clearly indicate that the closure-means was opened. Because the user during the first opening must exert an axial force toward the mouth and against the container to drive the screw-cap by means of the hood, he also must press by means of the edge zone of the hood the tear-off elements against the mouth, so that their claws remain anchored underneath the retaining lip of the mouth. As then the screw cap moves upward with respect to the mouth, necessarily the tear-off elements caught underneath the retaining lip of the mouth, must be torn off.

Terms such as "up" and "below" refer to the position of a closure-means for instance on an upright bottle.

FURTHER DEVELOPMENTS OF THE INVENTION

In a further development stated in claim 2, the screw cap can be made integral with the tear-off elements using the injection molding method.

In a further development stated in claim 3, the tear-off elements together with their claws can be easily removed from the molds after injection molding and tear-off stubs holding the tear-off elements remain undamaged when the closure means is mounted on the mouth for the first time.

According to claim 5, the tear-off elements can be further interconnected by easily tearing connecting stubs to better hold the tear-off elements when removed from the mold after injection molding and during the first closure of the mouth.

Different embodiments make possible different methods for the first mounting of a closure means to a mouth.

A closure-means designed per claim 10 may be snapped on following the screwing-on of the threaded cap, whereby the tear-off elements reach the position required for the original-seal safety, in which the claws engage underneath the mouth's retaining lip.

As stated in claim 11, this snap-in process can be replaced by a screw-in process. For that purpose an inside thread is provided at the hood and an associated outside thread at the screw cap.

As shown by claim 14, the original-seal closure-means simultaneously can be used as a child-proof closure means. Some of the studs or recesses are bevelled. When unscrewing, these bevels act in such a manner that the hood only slightly pressed against the screw cap performs a ratchet motion and accordingly a firmly seated screw cap will not be carried along. The screw cap can only be carried along if a substantial axial force is exerted, which a small child cannot.

BRIEF DESCRIPTION OF THE DRAWINGS

Two illustrative embodiments with further features of the invention are described below in relation to the drawing.

FIGS. 6 through 9 show a second embodiment with a screw-on cap. In particular:

FIGS. 1 and 2 are an axial section on the left and a side view on the right of the hood and screw cap resp. of the first embodiment.

FIG. 3 is partial topview of the screw cap of FIG. 2.

FIG. 5 shows an axial section on the left and a side view on the right of the hood and the screw cap with tear-off elements, following the first closure of the mouth.

FIGS. 6 and 7 show an axial section on the left and a side view on the right of the hood and screw cap resp. of the second embodiment.

FIG. 8 is a partial topview of the screw cap of FIG. 7.

FIG. 9 shows the screw cap and hood of FIGS. 6 through 8 on a bottle mouth following the screwing of screw cap and hood, before the original seal becomes operative.

DESCRIPTION OF THE PREFERRED EMBODIMENTS

First Embodiment

Figure 1:
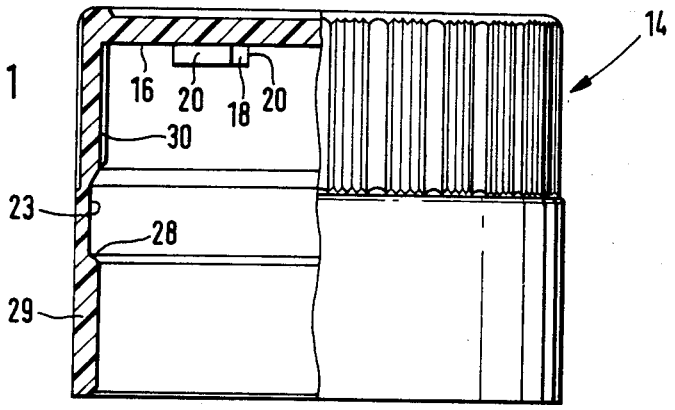
FIGS. 1 through 3 and 5 show a first embodiment with snap-on hood.

As shown by FIGS. 1 through 5, the screw cap 1 is provided with an inside thread 3 for the threaded bottle mouth 2. Six approximately radially directed rib-shaped studs 7 are provided at the end surface 5 of the screw cap. Similar studs 18 are present at the inside end face of the hood 14. The studs comprise mutually parallel flanks 9 and 20 resp. located in axial planes or planes parallel to the axis.

Above its lower edge the hood 14 is provided with a comparatively wide annular recess 23, and the screw cap 23 is provided on its outside with an annular bead 26 located some distance from the open end of the screw cap. After the screw cap has been snapped into the hood, the annular bead 26 can move axially within the annular recess 23. Accordingly the screw cap is held in undetachable manner and with play within the hood. In one of the end positions the studs 7 of the screw cap touch the end face 16 of the hood, while in the other end position the annular bead 26 rests against a shoulder 28 at the lower edge of the annular recess 23.

Three axially parallel ribs 30 are arranged on the inside wall of the hood 14 to prevent flopping of the the hood with respect to the screw cap.

Threaded mouths 2 at containers or bottles suitable to receive a screw cap with original-seal means have a retaining lip 32 (FIG. 4) generally located tightly underneath an outer thread 34.

Figure 5:
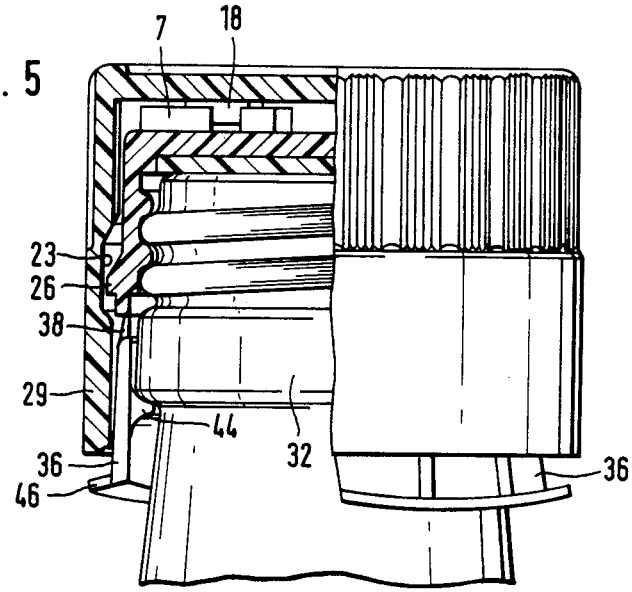

To secure the original seal, tear-off elements 36 are provided which are fastened to the edge of the screw cap 1 by tear-off stubs 38. In the embodiment shown, four tear-off elements 36 are provided, each being fastened by three tear-off stubs 38. The tear-off elements 36 are interconnected by connecting stubs 40. In the manufacturing stage shown in FIG. 2, the tear-off elements 36 are parts of a conical shell surface with a sector angle of about 30°. Except for the connecting stubs 40, said elements are separated by V-shaped cut-outs 42. Again the angle of divergence of each cut-out is about 30°. A claw 44 in the shape of an annular rib is present at the inside wall of each tear-off element. The claws are designed to engage behind the retaining lip 32 of the mouth 2. Each tear-off element is provided with an annular flange 46 at its outside wall at the lower edge. As shown by FIG. 5, this annular flange—which following the original sealing will project from underneath the edge of the hood—indicates that the closure has not yet been openeed.

To decrease the friction between the screw cap and the hood, each tear-off element 36 is provided with two outer ribs 48 extending approximately parallel to the generatrix of the conical surface of the tear-off elements.

Figure 2:
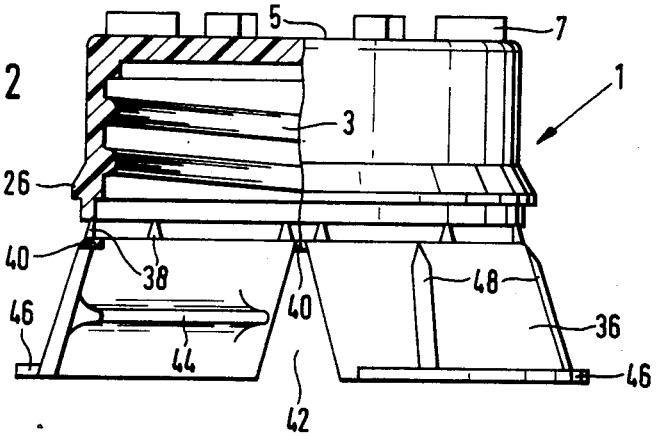
Figure 3:
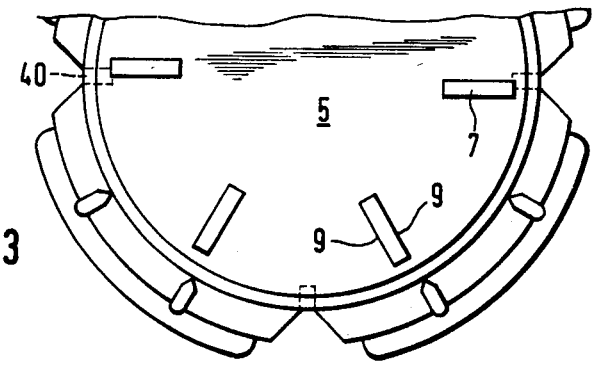
Figure 4:
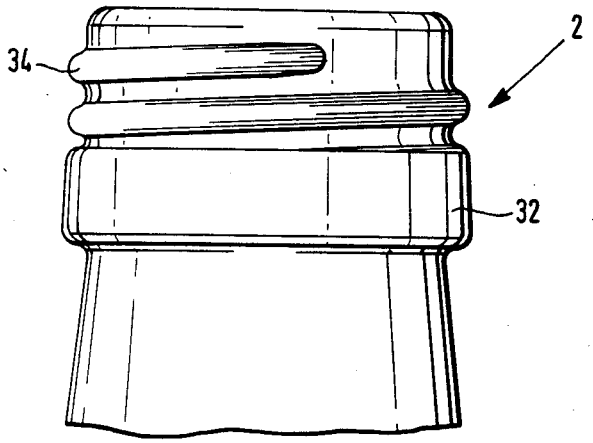
FIG. 4 is a sideview of the mouth of a bottle suitable for being fitted with closure means of the invention.

The screw cap is manufactured together with the tear-off elements in the position shown in FIGS. 2 and 3 by means of injection molding.

Operation of the first embodiment

To seal the mouth, first the screw cap is rotated on the bottle mouth, for instance by a sealing machine, with the tear-off elements 36 and their claws 44 easily reaching over the outer thread 34 and the retaining lip 32 of the mouth. Then the hood 14 is snapped axially in position over the screw cap 1, whereby the position shown in FIG. 5 is obtained where the annular bead 26 of the screw cap 1 engages the annular recess 23 of the hood 14. Thereby the hood has become undetachably held in the screw cap. The lower edge zone 29 of the hood now has forced inward the tear-off elements 36, and accordingly its claws 44 engage behind, that is underneath the retaining lip 32 of the mouth. The V-shaped cut-outs 42 between the tear-off elements have narrowed to a slit. The lower edges 50 of the tear-off elements now form arcs, whereas in the state of manufacture they were located in a radial plane.

If required, the closure means can be tightened further, in which event the studs 18 of the hood drive the studs 7 of the screw cap.

During the first unscrewing action, the hood must be forced against the screw cap so that the studs 18 of the hood can drive the studs 7 and hence by means of them the screw cap in the direction of rotation. In the process, the edge zone 29 perforce keeps the tear-off elements 36 pressed inward and thereby the claws 44 are held below the mouth retaining lip 32, whereby the tear-off elements 36 cannot move up. While the screw-cap is being rotated upward, the tear-off stubs 38 must necessarily be torn apart. Therefore the tear-off elements 36 are severed from the screw cap 1, and this fact indicates that the seal was opened.

Second Embodiment

The second embodiment is shown in FIGS. 6 through 9 and differs from the first in that the hood 14 can be screwed onto the screw cap 1. For that purpose, the outside wall of the screw cap is provided at its lower edge with a multi-turn, in this case a three-turn outer thread 60 and the hood 14 is provided at the lower edge of its zone 29 with a corresponding inner thread 62.

The hood is provided on its inner end 16 with studs 64 comprising flanks 66 and 68. Whereas the flanks 66 are located in axial planes or in planes parallel to the axis, the flanks 68 slant with respect ot the end surface 16 by an angle from 30 to 60°, in particular 45°. The result is a child-proof device as described below.

Both embodiments are similar as regards their essential operational parts.

Operation of the second embodiment

Figure 9:
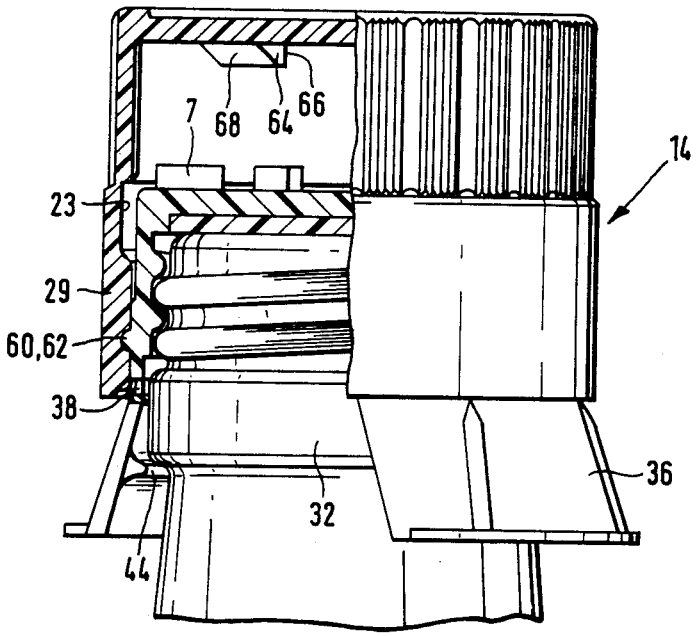

The hood 14 is screwed on the screw or inside cap 1 in a position shown in FIG. 9 already before the mouth is sealed. In the process the tear-off elements 36 project outward unhindered, and this also applies to FIGS. 7 and 8. The screwing of the hood on the screw cap first is terminated by the beginning of the outer thread 60 of the screw cap 1 butting against the ends of the hood inner thread 62. When the closure means is rotated in this manner onto the mouth 2, the torque thusly transmitted by the hood and screw cap suffices to screw tight the screw cap 1 onto the outer thread 34 of the mouth. If then a higher torque is applied and/or the hood is snapped on, the lower edge zone 29 expands and slips over the outer thread 60 until this thread 60 moves into the annular groove 23. Thereby the two closure parts again will be fastened to each other undetachably.

Furthermore the studs 64 and 7 sequentially engage in the direction of rotation. If required, the closure means can then be screwed even tighter. As in the first embodiment, the edge zone 29 forces inward the tear-off elements 36 during the axial downward motion of the hood 14 with respect to the screw cap 1, whereby the claws 44 engage underneath the retaining lip 32 of the mouth.

When unscrewing, the hood 14 again must be pressed against the mouth. The closure means has the child-proof effect known per se. If the attempt is made to open the closure means by merely rotating the hood in the counterclockwise sense, then this hood either turns idly or the oblique flanks 68 of the studs 64 of the hood perform a ratcheting motion on the screw-cap studs 7, without the screw cap being carried along. It is only when a sufficiently large force is exerted in the axial direction toward the mouth that the slanted flanks 68 can drive the studs 7, whereby the screw cap 1 will be unscrewed.

The lower edge zone 29 again forces the tear-off elements 36 against the mouth during the unscrewing process and keeps the claws 44 underneath the retaining lip 32 of the mouth, and as a result the tear-off stubs 38 must be torn apart.

We claim:

1. A plastic, original-seal closure means for threaded mouths with retaining lips on containers, in particular bottles, characterized by the following features:

(a) The closure means includes a screw (sealing) cap (1) to which is fastened a hood (14) with axial play, studs (7, 18; 64) or studs and recesses being provided both at the hood and at the screw cap, which studs or studs and recesses can engage and disengage within the axial play;

(b) Tear-off elements (36) are provided at the screw cap (1) and comprise claws (44) for engaging underneath the retaining lip (32) of the threaded mouth;

(c) The hood (14) comprises a special cylindrical edge zone (29) which in the position of secured original seal includes the tear-off elements (or at least a substantial axial part of the tear-off elements) between the hood (14) and the threaded mouth (2) and which keeps the claws (44) behind the retaining lip (32).

2. Original-seal closure-means per claim 1, characterized by the following features:

(a) The screw cap (1) and the tear-off elements (36) are manufactured in integral manner, especially by injection-molding;

(b) In the manufactured state the tear-off elements are part of a conical shell;

(c) The conical shell comprises cut-outs (42) permitting to fold the tear-off elements into a shape, especially a cylindrical shape, corresponding to the mouth;

(d) Each tear-off element is connected by at least one tear-off stub (38) with the edge of the screw cap (1).

3. Original-seal closure means per claim 2, characterized in that the conical shell assumes a sector angle between 20° and 40°, especially about 30°, in such a manner that in the manufactured state the free space within the claws (44) is of a slightly larger diameter than the mouth to be sealed.

4. Original-seal closure means per claim 3, characterized by the following features:

(a) The cut-outs (42) are approximately triangular and flare toward the free end of the tear-off elements;

(b) The aperture angle of the cut-outs is about the same as that of the sector angle.

5. Original-seal closure means per claim 2, characterized in that the tear-off elements are held together at their edge facing the screw cap by means of easily torn-apart connection stubs (40).

6. Original-seal closure means per claim 1, characterized in that the claws (44) assume the shapes of projections entering the inside walls of the tear-off elements.

7. Original-seal closure means per claim 6, characterized in that the claws (44) are circumferential ribs extending over a substantial part of the width of the tear-off elements.

8. Original-seal closure means per claim 1, characterized in that the tear-off elements are provided with segments of annular flanges (46) projecting from the outsides of said tear-off elements to identify the original seal, said flange parts being located at or near the wide edges of the tear-off elements.

9. Original-seal closure means per claim 1, characterized in that to reduce the friction between the hood and the screw cap, ribs (48) are provided on the outside of the tear-off elements which extend approximately parallel to the generatrix of the conical surface.

10. Original-seal closure means per claim 1, characterized by the following features:

(a) The hood includes an edge zone (29) with an axial height nearly equal to the axial height of the inwardly folded tear-off elements without any lower annular flange (46);

(b) The hood is provided above its edge zone (29) with an annular recess (23) to receive an outer annular bead (26) of the screw cap;

(c) The axial heights of the annular bead and of the annular recess are so adjusted with respect to each other that the hood is provided with an axial play relative to the screw cap to engage or disengage the torque-transmitting studs (7, 18) or studs and recesses.

11. Original-seal closure means per claim 1, characterized by the following features:

(a) The hood has an edge zone (29) with an axial height nearly equal the axial height of the inwardly folded tear-off elements without any lower annular flange (46) being present;

(b) The screw cap is provided near its edge an outer thread (60) especially of several turns and the hood is provided at its edge with a matching inner thread (62);

(c) The hood is provided above its edge zone (29) with an annular recess (23) to receive the outer thread of the screw cap;

(d) The axial heights of the outer thread and of the annular recess are so mutually adjusted that the hood is provided with the required axial play relative to the screw cap to engage and disengage the torque-transmitting studs (7,64) or studs and recesses.

12. Original-seal closure means per claim 11, characterized in that a means for braking the screw-in process is provided at the screw cap and/or hood, said braking means becoming effective after a brief screwing motion and being overcome only by a torque adequate to seal the threaded mouth by the screw cap.

13. Original-seal closure means per claim 12, characterized in that the screw-in brake means is composed of that part of the edge zone (29) remaining above the inside thread (62) and of the outer thread (60) in association with the elastic deformability of the parts.

14. Original-seal closure means per claim 1, characterized in that those flanks (9,66) of the studs (7,64) or recesses which butt against each other during the screw-in process are designed as the drivers whereas those flanks (9, 68) which butt against each other when unscrewing exert a wedge effect in such a manner that the screw cap is carried along by the hood during the screwing-shut procedure, whereas during unscrewing the screw cap is carried along only by an axial force acting on the hood and directed toward the container.

* * * * *